United States Patent [19]

Gertsch

[11] 4,438,948

[45] Mar. 27, 1984

[54] SOLE-SUPPORT PLATE

[75] Inventor: Ulrich Gertsch, Interlaken, Switzerland

[73] Assignee: TMC Corporation, Baar, Switzerland

[21] Appl. No.: 379,222

[22] Filed: May 17, 1982

[30] Foreign Application Priority Data

May 25, 1981 [CH] Switzerland ..... 3390/81

[51] Int. Cl.[3] ..... A63C 9/081

[52] U.S. Cl. ..... 280/618; 280/607; 280/636

[58] Field of Search ..... 280/607, 613, 617, 618, 280/620, 633, 636

[56] References Cited

U.S. PATENT DOCUMENTS

| | | | |
|---|---|---|---|
| 3,145,027 | 8/1964 | Berchtold | 280/636 |
| 4,113,276 | 8/1978 | Kirsch | 280/618 |
| 4,141,571 | 2/1979 | Beyl | 280/620 |
| 4,147,378 | 4/1979 | Reich | 280/633 |

FOREIGN PATENT DOCUMENTS

| | | | |
|---|---|---|---|
| 1905217 | 8/1970 | Fed. Rep. of Germany | 280/617 |
| 2058671 | 5/1972 | Fed. Rep. of Germany | 280/618 |

*Primary Examiner*—Joseph F. Peters, Jr.
*Assistant Examiner*—Timothy Roesch
*Attorney, Agent, or Firm*—Flynn, Thiel, Boutell & Tanis

[57] ABSTRACT

A sole-support plate for a release ski binding is supported on the upper side of a ski by a pivot bearing and cooperates with a resilient restoring arrangement. The restoring arrangement includes an opening provided in the sole-support plate, which plate is made of an elastic material, the opening weakening the sole-support plate in the area of the pivot bearing so that it can be swung laterally through elastic deformation of the region having the opening and will thereafter return automatically to its original position through the resilience of this region.

13 Claims, 8 Drawing Figures

SOLE-SUPPORT PLATE

FIELD OF THE INVENTION

This invention relates to a sole-support plate of a ski binding and, more particularly, to a sole-support plate having at least one end supported for limited movement laterally of the ski.

BACKGROUND OF THE INVENTION

In a sole-support plate of this type, which is known for example from Swiss Pat. No. 47 78 90, the pivot bearing is formed by a screw which secures the sole plate on the upper side of the ski. The sole-support plate can be pivoted a limited amount to both sides of the ski about this pivot bearing from a base or original position in which it is parallel to the longitudinal axis of the ski. The end of the sole-support plate remote from the pivot bearing is constructed as a spring cage in which, between the upper side of the ski and the bottom of the sole-support plate, two arcuate springs are provided which are supported on a ski-fixed stop. These springs press with an initial tension against lateral stops provided on the sole-support plate. During lateral swinging of the sole-support plate from its base position, at least one of the springs will be elastically deformed and, after the release of the ski shoe, will urge the sole-support plate back to its base position. The structure here is relatively complex, as many individual parts are needed which are difficult to mount and are exposed to a heavy wear. This zero adjuster therefore cannot assure a constant swing-out resistance for the sole-support plate, which is important for maintaining constant friction conditions during the release of the ski binding. Furthermore, in order to protectively encase the zero adjuster, a considerable height is needed for the release plate.

Austrian Pat. No. 310 626 discloses a sole-support device for a release ski binding which includes a U-shaped wire bar, the leg ends of which are anchored in a base plate which is secured on the ski. The legs, which in the original or base position extend approximately parallel with respect to the longitudinal direction of the ski, carry cylindrical rollers which rest on the underside of the ski shoe sole. During a swinging out of the ski shoe, the ski shoe bends, by means of the rollers, the legs of the bar parallel to the upper side of the ski so that the bearing areas of the ski shoe sole move in the swing-out direction. As soon as the ski shoe comes free from a binding part which is adjacent to the sole-support device, the pressure exerted by the ski shoe sole on the rollers is eliminated and the legs of the bar spring back again. Since the anchoring of the bar and the swivel axis of the ski shoe lie opposite during swinging out, a relative and opposite movement takes place between the underside of the ski shoe sole and the rollers or the legs of the bar, during which movement no clear friction relationship exists between the ski shoe sole and the rollers, which is a disadvantage, and more so because the contact areas between the ski shoe sole and the rollers are extraordinarily small. Also, one must fear that snow present in the bearing areas can reduce the friction between the ski shoe sole and the rollers sufficiently so that the bar is not deformed at all during a swinging out of the ski shoe. Thus, it cannot be assured that, during all release operations, friction conditions exist which are consistent and predictable and can be considered in relationship to the release behavior of the ski binding right from the start, particularly since snow and dirt can penetrate substantially unhindered into the inside of the support device between the ski upper side and the underside of the ski shoe.

One purpose of the invention is thus to provide a sole-support plate of the above-mentioned type which includes as few individual parts as possible and assures a constant swing-out resistance and thus constant friction conditions in the safety ski binding.

SUMMARY OF THE INVENTION

This purpose is attained inventively by providing a sole-support plate of the foregoing type in which the sole-support plate, at least in the region of the pivot bearing, is made of a resilient material, the zero adjuster including at least one first opening provided in such region. At least one end of the sole-support plate can be swung laterally through elastic deformation of the region having the first opening therein, the resilience of such region subsequently returning the sole-support plate to its original position.

In this construction, the sole-support plate itself acts as the zero adjuster, since the resilient material of which the sole-support plate is made and the opening therein create elastically deformable bending zones, whereby the swivelling movement of the sole-support plate can take place on the one hand and, at the same time, the necessary restoring forces are created to return the sole-support plate to its original position. This sole-support plate can be constructed in one piece, thereby simplifying its manufacture and installation. Furthermore, in the case of this construction, change of the swing-out resistance due to outside influences is not to be feared. Since no separate components must be arranged within the plate, the structural height of the sole-support plate can be kept relatively small. The sole-support plate can thereby be made of a resilient plastic and/or of a resilient metal. It is obvious that, through selection of the size and the shape of the opening, the swing-out resistance and the restoring forces can be predetermined, as can the swivel radius of the sole-support plate.

In an advantageous embodiment, the first opening is provided in the region of the pivot bearing. Lateral swing-out forces thus act on the region of the pivot bearing through a relatively large lever arm.

In an advantageous embodiment of the invention, the opening in the sole-support plate is U-shaped and has two legs extending parallel to each other and parallel to the longitudinal axis of the ski. This shape of the opening can easily be manufactured, for example if the sole-support plate is a plastic injection molded part. The areas of the sole-support plate which, during a lateral swinging out, are exposed to an elastic deformation can be designed so that an optimum functioning of the sole-support plate is achieved.

In a further advantageous embodiment of the invention, the U-shaped opening surrounds in the region of the pivot bearing a first fastening point of the sole-support plate, the legs of the opening extending toward a second fastening point remote from the movable end of the sole-support plate. In this arrangement of the U-shaped opening a relatively large lever arm for the restoring forces is obtained, since the second fastening point lies a considerable distance from the regions in which the elastic deformation occurs. Forces which occur during the lateral swinging of the sole-support plate are transferred particularly evenly onto the fastening points and peak stresses are avoided in localized areas of the sole-support plate if the U-shaped opening defines in the sole-support plate a center web and two narrow outer webs.

In a further, advantageous embodiment of the invention, a disk is secured at the first fastening points of the sole-support plate and is received in a second opening provided in the sole-support plate, a plurality of first openings defining longitudinally extending webs between the second opening and a second fastening point. In this construction, relative rotary movement between the disk and the second opening takes place during lateral swinging movement of the sole-support plate, which movement is thus guided exactly. The areas of the sole-support plate adjacent the first openings are flexible webs which oppose the swing-out movement with a predetermined resistance and assure a satisfactory return of the sole-support plate to the base position after the swinging out. Here, too, a realtively long lever arm exists between the second fixed fastening point and the regions in which the elastic deformation takes place.

In a further advantageous embodiment of the invention, a wide first opening is provided closely behind the second opening and extends to the end of the sole-support plate, thereby defining narrow, fork-tinelike extensions on the sole-support plate. At the second fastening point a fastening plate is secured on the upper side of the ski, such plate having a width substantially equal to the width of the first opening and being disposed between the extensions. In this construction, there is also a satisfactory swivelling guide of the sole-support plate around the disk, the fork-tinelike extensions influencing only slightly the swivelling movement. They are primarily responsible for returning the sole-support plate to its base position, for whicn purpose they are supported against the fastening plate.

Also advantageous is a construction in which the first opening is provided at an end of the sole-support plate remote from the support means and defines fork-tinelike extensions, a ski-fixed plate being disposed between and having a width substantially equal to that of the first opening.

In a further important development of the invention, the fastening points for the sole-support plate are aligned with the fastening points of a heel holder. Due to this measure, separate fastening elements for the sole-support plate are not neeced and thus additional fastening points are not needed in the ski. Rather, the sole-support plate is properly secured by simply mounting the heel holder in the functionally correct position. Since, however, the heel holder could hinder the lateral movement of the sole-support plate, it is beneficial if an arrangement is provided to effect a spacing between the underside of the heel holder and the upper side of the sole-support plate. The spacing between the bottom side of the heel holder and the upper side of the sole-support plate permits free swivelling movement of the latter. This can be realized easily oy providing space-maintaining projections on the upper side of the sole-support plate. These space-maintaining projections are advantageously provided on a region of the upper surface area of the sole-support plate which, during the swing-out movement, does not move with respect to the heel holder.

In a further important arrangement for achieving such spacing, at least one of the disk and the fastening plate has a greater vertical height than the sole-support plate in the region of the pivot bearing. The heel holder, which is securely fixed on the upper side of the ski, thereby presses firmly on the disk and/or the fastening plate. Without provisions of this type, the sole-support plate could be hindered in its capability to swivel.

In addition, it is advantageous if at least one first opening extends longitudinally of the ski and is located in front of or behind the region of the pivot bearing. This construction of a sole-support plate can be used for a so-called center-point binding in which the binding elements are arranged in the sole center of the ski shoe and are secured on the ski. The sole-support plate supports then the front and rear ends of the ski-shoe sole, whereby the two ends of the plate, due to the cut-out section and its shape and size, can swing laterally with the ski shoe when a twisting release occurs.

It is obvious that the sole-support plate according to the invention need not be made entirely of a resilient material. Rather, it is sufficient if the sole-support plate is made of a resilient material only in the region of the pivot bearing. The resilience of the material, even if present only in the region of the pivot bearing, results in a further advantage, since the sole-support plate can be lifted upwardly away from the upper side of the ski at its end remote from the pivot bearing, so that the space below the sole-support plate can be cleaned.

The sole-engaging area on the sole-support plate advantageously pivots almost exactly about the actual pivot point of the ski shoe.

BRIEF DESCRIPTION OF THE DRAWINGS

Exemplary embodiments of the invention will be discussed in detail hereinafter in connection with the drawings, in which.

DETAILED DESCRIPTION

Figure 1:
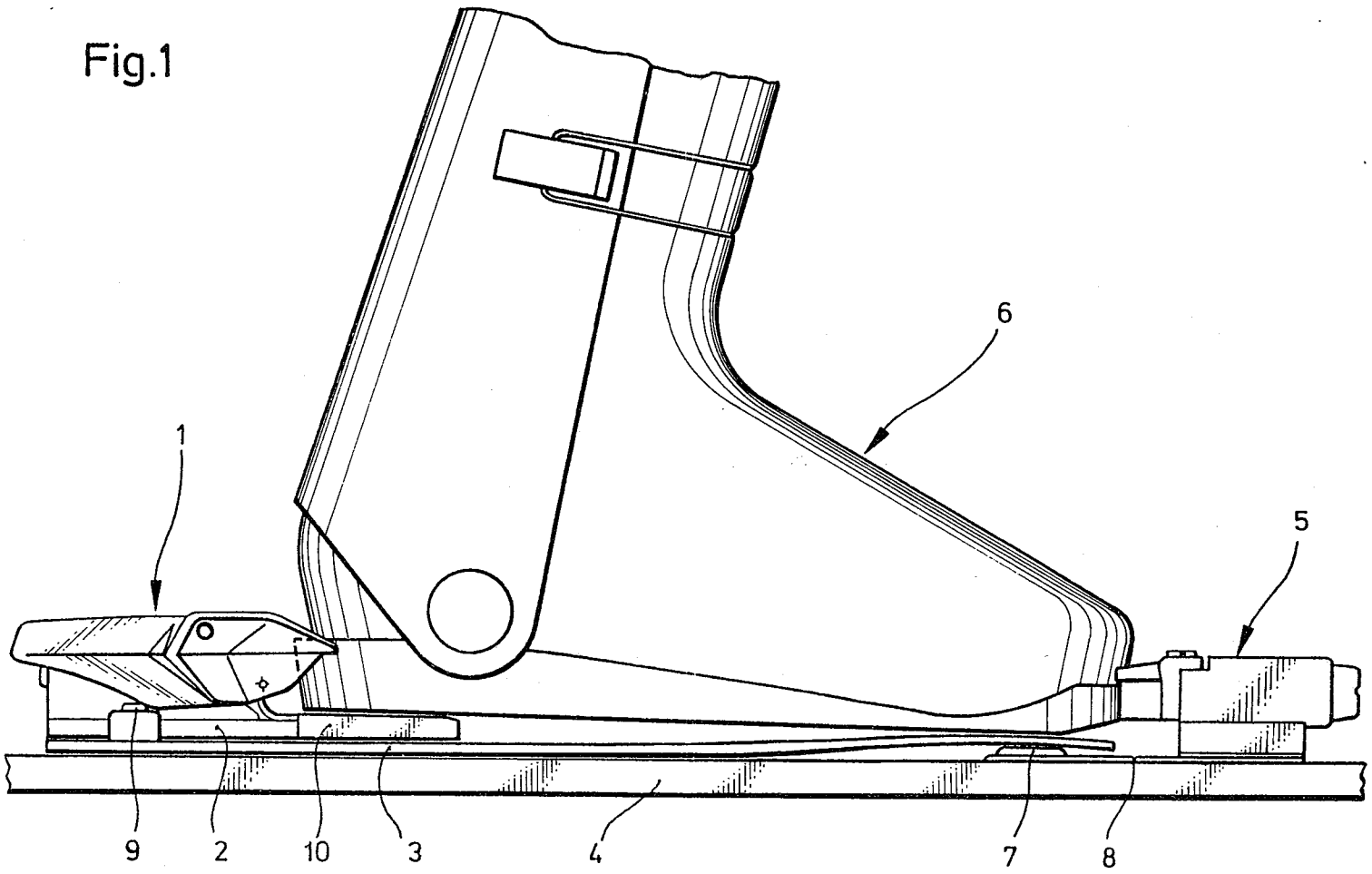
FIG. 1 is a side view of a release ski binding in which a ski shoe is supported on a sole-support plate embodying the present invention.

A conventional ski shoe 6 is secured on a ski, as shown in FIG. 1, by a release ski binding which includes a heel holder 1 and toe holder 5 which are both of conventional construction. The heel holder 1 is secured on the ski 4 by fastening screws 9 with a sole-support plate 3 therebetween. Reference numeral 10 indicates a stepping plate provided on the heel holder 1 and cooperable with the rear end of the ski shoe sole. The heel holder 1 also includes a base plate 2.

The front end of the ski shoe sole rests on the front end of the sole-support plate 3, which in this area is supported on the ski 4 by a sliding strip 7. The sliding strip 7 is connected to the toe holder 5 by a connecting plate 8.

The sliding strip 7 is conventional, and is preferably of the type having an upper surface made of a low friction material such as polytetrafluoroethylene.

Figure 2:
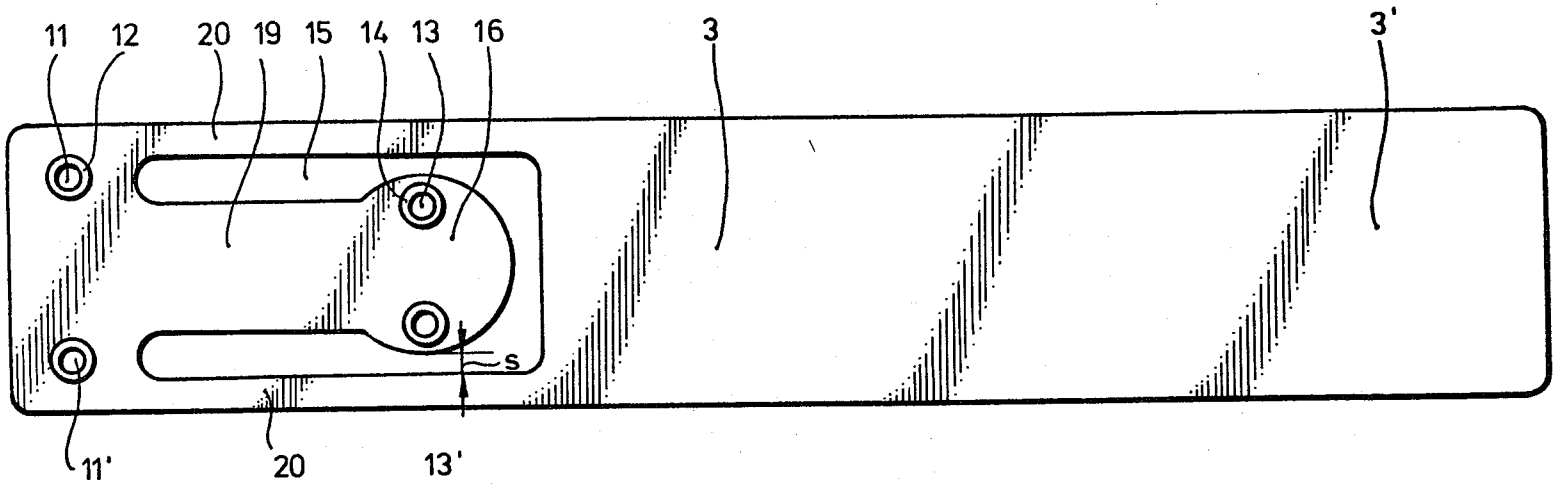
FIG. 2 is a top view of the sole-support plate of FIG. 1.
Figure 3:
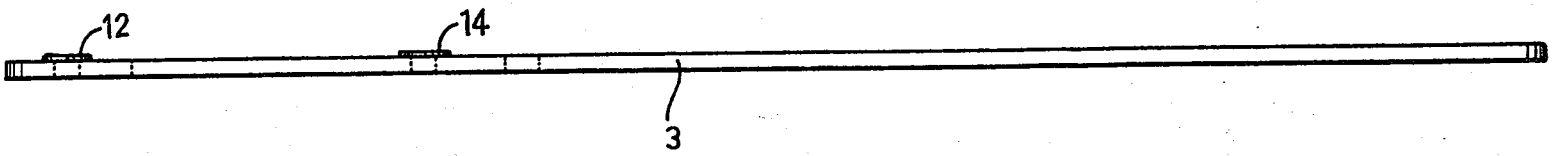
FIG. 3 is a side view of the sole-support plate of FIG. 1.

The sole-support plate 3 is shown in detail in FIGS. 2 and 3. The front end 3' of the sole-support plate 3 can be swung laterally outwardly a limited distance to either side from its base or original position. In addition, the front end 3' can be lifted upwardly somewhat away from the upper side of the ski. The capability of the front end of the sole-support plate 3 to swing laterally prevents snow, ice, dirt and wear of the sole due to walking from exerting undesirable influences on the release behavior of the release ski binding. The vertical movability of the front end 3' of the sole-support plate 3 has the advantage that dirt which has accumulated between the sliding strip 7 and the underside of the sole-support plate 3, for example during skiing or during transport on the roof of a car, can be easily removed.

The sole-support plate 3 of FIGS. 1 to 3 has some resilient flexibility and is preferably manufactured in one piece of a plastic or a metal material. The mounting of the sole-support plate 3 is simple, since the locations of the fastening points 11, 11', 13 and 13' in the sole-support plate 3 correspond to and are aligned with the locations of the fastening points for the heel holder 1. Thus, the sole-support plate 3 and the heel holder 1 can both be mounted using the screws 9.

In the region of the sole-support plate 3 which is secured by means of the heel holder screws 9 to the ski, an opening 15 which is U-shaped in the top view is provided and defines webs 19 and 20 which are narrow and extend longitudinally of the sole-support plate 3. Due to the flexibility of the material of the sole-support plate 3, the webs 19 and 20 are deformed elastically when the front end 3' of the sole-support plate 3 swings to the side during a release. The front end 3' of the sole-support plate can swing sufficiently far to either side so that the distance s which exists on each side of the fastening points 13, 13' is bridged, in other words is reduced to zero. In the area of the fastening points 13, 13' the web 19 ends in a rounded part 16, through which a satisfactory support of the sole-support plate 3 on the ski is achieved.

In order that the movability of the sole-support plate is not influenced by the heel holder, elevated projections 14 and 12 are provided around the fastening points 13, 13', 11 and 11' to assure a certain distance exists between the underside of the base plate 2 of the heel holder and the upper side of the sole-support plate 3. In place of the projections 14 and 12 it is also possible to use washers.

After a lateral swing-out of the end 3' of the support plate 3 has occurred and the ski shoe has come free from the release ski binding, the resilient webs 19 and 20 return to their original shape and position and thus center the front end 3' in its original position.

Figure 4:
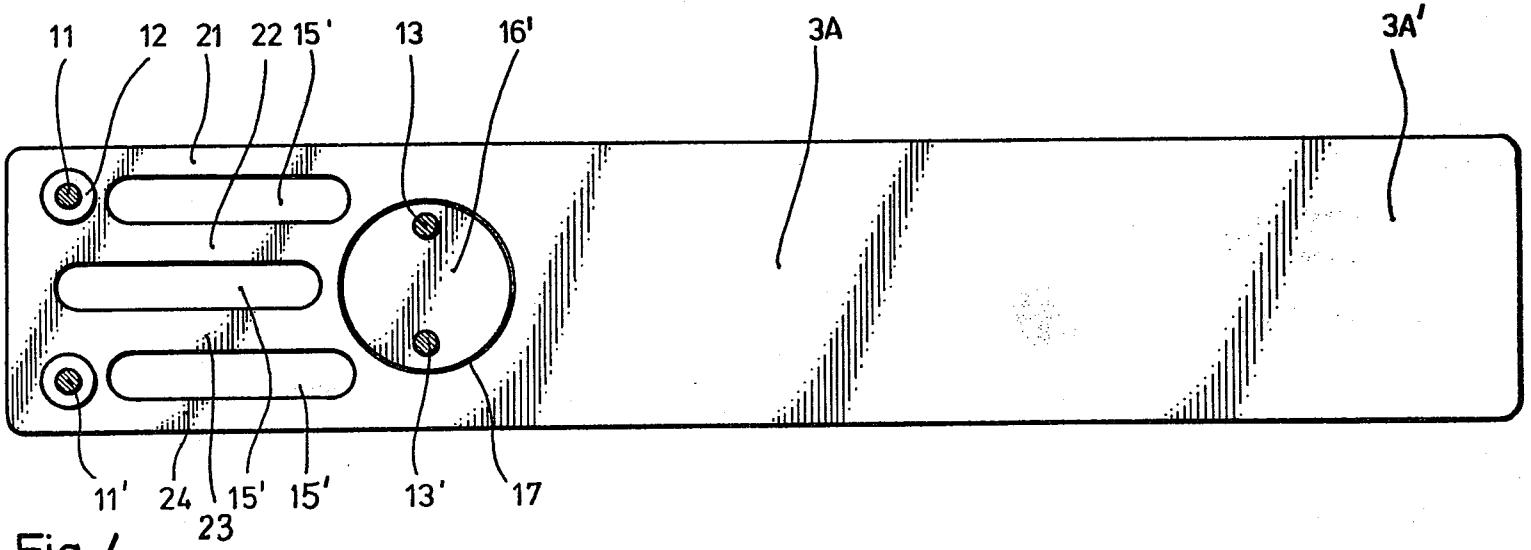
FIGS. 4 and 5 are respectively a top view and a side view of a second sole-support plate embodying the invention.
Figure 5:
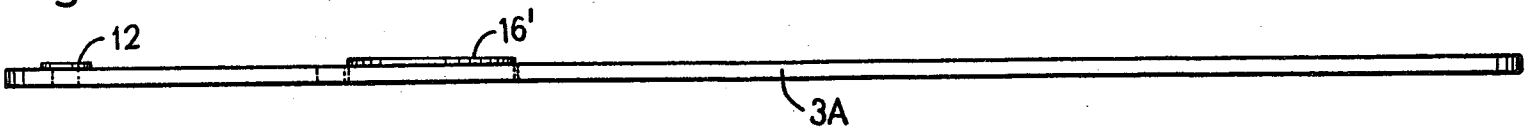

In the embodiment of FIGS. 4 and 5, the fastening points 13, 13', 11 and 11' are provided which are again aligned with the fastening points of the heel holder. Three openings 15' which extend longitudinally of the sole-support plate 3A are provided and define narrow, longitudinally extending webs 21, 22, 23 and 24. A disk 16' is nonrotatably secured to the upper side of the ski at the fastening points 13, 13' and engages a circular opening 17 provided in the sole-support plate 3A.

Raised projections 12 are again provided at the fastening points 11 and 11' for maintaining a space between a heel holder and the upper side of the sole-support plate 3A. In addition, the disk 16' is constructed with greater vertical height than the sole-support plate 3A so that the distance between support plate 3A and a heel holder base plate is assured in a simple manner.

A rotary movement is carried out here around the disk 16' during the swinging out of the sole-support plate 3A, which movement is permitted by a resilient deformation of the webs 21 to 24. As soon as the ski shoe has come free from the release ski binding, the webs 21 to 24 return to their normal position, which causes the front end 3A' to be returned to its original position.

Figure 6:
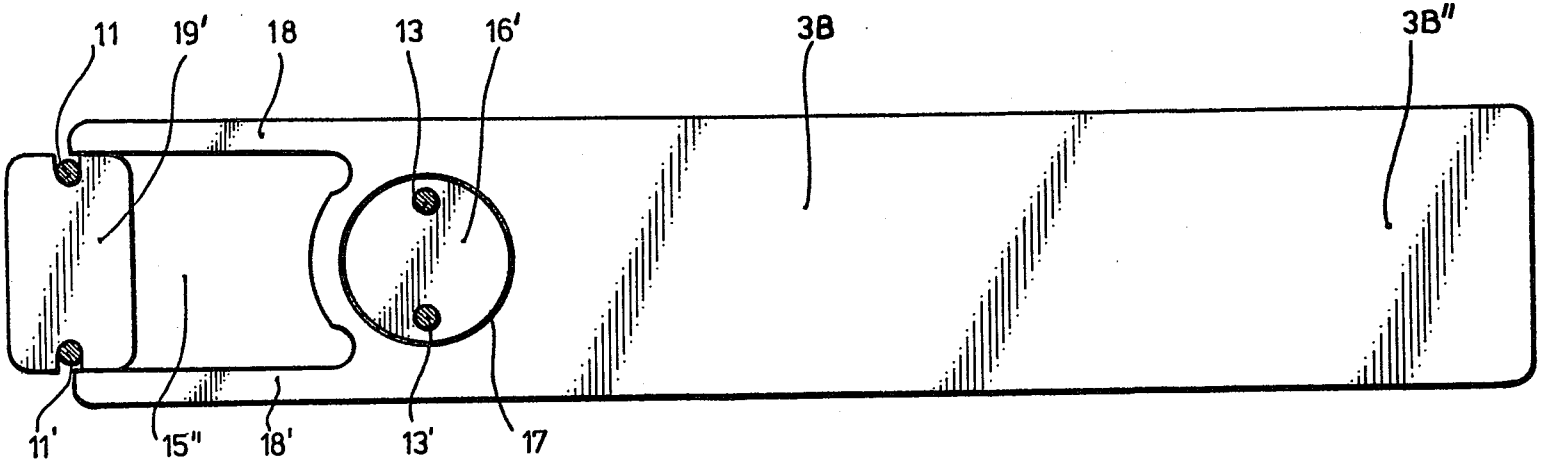
FIGS. 6 and 7 are respectively a top view and a side view of a further sole-support plate embodying the invention.
Figure 7:
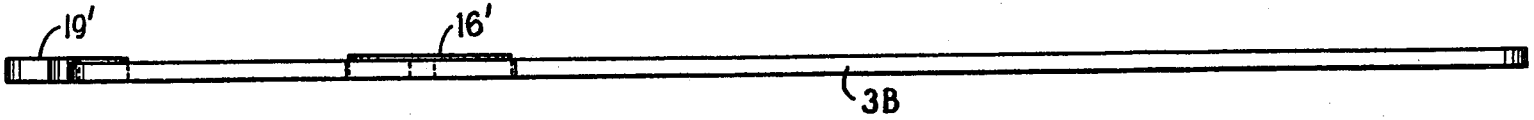

In the embodiment of FIGS. 6 and 7, a sole-support plate 3B is again equipped with a circular opening 17 in which a disk 16' is received, which disk in turn is secured on the ski at the fastening points 13, 13'. An opening 15" is provided in the plate 3 on the side of the opening 17 remote from the front end 3B'. The opening 15" extends to the rear end of the sole-support plate 3B and is somewhat wider than the openings 15 and 15' in the exemplary embodiments of FIGS. 1 to 5. The opening 15" defines fork-tinelike and spaced extensions 18 and 18' which, due to the resilience of the material of the sole-support plate, can easily be flexed. A fastening plate 19' is provided between the two extensions 18 and 18' and is secured to the ski at the fastening points 11, 11'. Depending on the direction in which the front end 3B' is swung outwardly, one of the extensions 18, 18' will be flexed and, after the ski shoe is released, will return the sole-support plate 3B to its original position. To assure that an adequate distance exists between the upper side of the sole-support plate 3B and the underside of the heel holder (not shown), the disk 16' and the plate 19' here each have a greater vertical height than the sole-support plate 3B.

It is conceivable to equip the described sole-support plate, regardless of whether it is made of plastic, metal or a combination of these two materials, with reinforcing ribs in the front region thereof.

Since it is furthermore of no importance whether the front end of the sole-support plate is flush with the front edge of the sliding strip, projects therebeyond, or ends therebehind, it is not nedessary to construct a different size of the sole-support plate for each ski shoe size. It is sufficient in practice to provide two or three different lengths of the sole-support plate in order to adequately cover the entire range of size differences between ski shoes (approximately 80 mm.).

Figure 8:
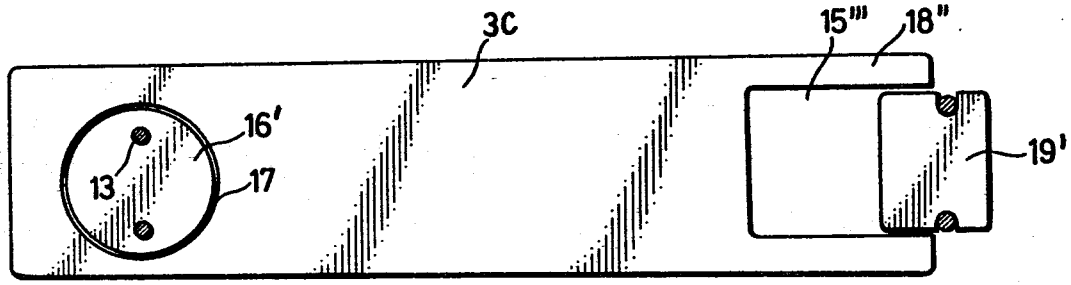
FIG. 8 is a top view of a fourth sole-support plate embodying the invention.

In the further embodiment shown in FIG. 8, a sole-support plate 3C has a pivot bearing defined by a ski-fixed disk 16' which is received in an opening 17 provided adjacent one end of the plate, for example in the heel area, and a wide opening 15''' is provided at the other end of the plate, for example the toe area, and defines fork-tinelike extensions 18" at that end. A ski-fixed plate 19' is disposed between the extensions 18", which plate can be part of a front jaw of the binding. During a lateral swinging out of the sole-support plate 3C, one of the extensions 18" will be flexed, since it is supported on the plate 19'. The resilience of the material of the plate 3C then assures a return of the sole-support plate 3 to its base position.

Openings could also be arranged so that only a single extension is created which is received between two fastening points or in a recess of the plate 19'. This extension would act like a spring and be flexed to one side or the other, depending on the direction of movement of the ski shoe and sole-support plate, and would return the sole-support plate 3C to its base position.

It is furthermore conceivable to arrange the pivot bearing of the described sole-support plate in the area of the toe holder in the case of a release ski binding in which, during a fall, lateral movement of the ski shoe takes place in the heel area.

The discussed principle is also usable for a so-called center-point binding. In this case, the pivot bearing of the sole-support plate is provided in the area of the sole center, and openings would be provided on both sides of the pivot-bearing area in order to obtain the desired lateral movability of both ends of the sole-support plate.

Finally, it would also be possible to mount the discussed sole-support plate on the stepping plate of a cross-country ski binding. The use of such a sole-support plate would be particularly advantageous in conjunction with the nonskid soles which are common in cross-country ski shoes.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a sole-support plate for a release ski binding, including means for supporting said sole-support plate on the upper side of a ski so that at least one end thereof is movable laterally of the ski, and including restoring means for resiliently urging said plate back into its original position after such lateral movement, the improvement comprising wherein said restoring means includes at least one first opening provided in said sole-support plate, and wherein said sole-support plate, at least in the region of said first opening, is made of a resilient material, said first opening weakening said sole-support plate in the region of said resilient material so that said lateral movement is effected by elastic deformation of the region of said sole-support plate having said first opening therein and, after the lateral movement, said sole-support plate is returned automatically to its original position by said resilience of said region of said sole-support plate having said first opening therein.

2. The sole-support plate according to claim 1, wherein the first opening is provided in the area of the support means.

3. The sole-support plate according to claim 2, wherein said first opening, in a top view of the sole-support plate, is approximately U-shaped, the legs thereof extending approximately parallel to one another and to the longitudinal axis of the ski.

4. The sole-support plate according to claim 3, wherein said U-shaped opening surrounds, in the region of said support means, a first fastening point of the sole-support plate, said legs of said first opening extending toward a second fastening point remote from the end of the sole-support plate, which can be moved laterally.

5. The sole-support plate according to claim 3, wherein the U-shaped opening defines in the sole-support plate a center web and two narrow outer webs.

6. The sole-support plate according to claim 1, wherein said support means includes a disk secured at a first fastening point and received in a second opening Provided in the sole-support plate, and wherein between the second opening and a second fastening point there are provided a plurality of said first openings which define several longitudinally extending webs in said sole-support plate.

7. The sole-support plate according to claim 1, wherein said support means includes a disk secured at a first fastening point and received in a second opening provided in the sole-support plate, wherein closely behind the second opening is provided said first opening which is wide, extends to the rear end of the sole-support plate and defines narrow and fork-tinelike extensions on the sole-support plate, and wherein at said second fastening point there is secured on the upper side of the ski a fastening plate with a width which substantially corresponds to the width of said first opening and is received between said extensions,

8. The sole-support plate according to claim 1, wherein the first opening is provided at an end of the sole-support plate remote from the support means and defines fork-tinelike extensions, and wherein between the extensions there is disposed a ski-fixed plate or a ski-fixed binding part having a width substantially equal to that of the first opening.

9. The sole-support plate according to claim 1, wherein said sole-support plate includes fastening points which are aligned with the fastening points of a heel holder.

10. The sole-support plate according to claim 1, wherein means are provided for effecting a spacing between the underside of a heel holder and the upper side of the sole-support plate.

11. The sole-support plate according to claim 9, wherein space-maintaining projections are provided on the upper side of the sole-support plate.

12. The sole-support plate according to claim 7 or claim 8, wherein at least one of said disk and said fastening plate has a greater height than said sole-support plate in the region of said support means.

13. The sole-support plate according to claim 1, wherein at least one said first opening extends longitudinally of the ski and is located in front of or behind the region of the support means.

* * * * *